US010926428B2

(12) United States Patent
Nguyen et al.

(10) Patent No.: US 10,926,428 B2
(45) Date of Patent: Feb. 23, 2021

(54) WINGED CUTTER

(71) Applicant: Pacific Handy Cutter, Inc., Irvine, CA (US)

(72) Inventors: Kelvin Tuan Nguyen, Fountain Valley, CA (US); Joseph P. Garavaglia, Newport Beach, CA (US); Kody Numedahl, Orange, CA (US); Mark Marinovich, Rancho Santa Fe, CA (US)

(73) Assignee: Pacific Handy Cutter, Inc., Irvine, CA (US)

( * ) Notice: Subject to any disclaimer, the term of this patent is extended or adjusted under 35 U.S.C. 154(b) by 0 days.

(21) Appl. No.: 16/660,720

(22) Filed: Oct. 22, 2019

(65) Prior Publication Data

US 2020/0215708 A1 Jul. 9, 2020

Related U.S. Application Data

(63) Continuation-in-part of application No. 29/618,904, filed on Sep. 25, 2017, now Pat. No. Des. 863,924.

(51) Int. Cl.

| | |
|---|---|
| ***B26B 27/00*** | (2006.01) |
| ***B26B 29/06*** | (2006.01) |
| ***D06H 7/00*** | (2006.01) |

(52) U.S. Cl.

CPC ..... *B26B 27/005* (2013.01); *B26B 29/06* (2013.01); *D06H 7/00* (2013.01)

(58) Field of Classification Search

CPC ..... B26B 27/005; B26B 29/06; D06H 7/00

USPC ..... 30/278, 280, 294, 314

See application file for complete search history.

(56) References Cited

U.S. PATENT DOCUMENTS

| | | | | |
|---|---|---|---|---|
| D126,717 | S * | 4/1941 | Futterman | D8/98 |
| 3,028,670 | A * | 4/1962 | Tilly | B43M 7/002 30/294 |
| 3,893,238 | A * | 7/1975 | Scholl | A47G 27/0487 30/294 |
| 4,134,206 | A * | 1/1979 | Beermann | B26B 5/006 30/294 |
| D254,243 | S * | 2/1980 | Florian | 30/294 |
| 4,503,612 | A * | 3/1985 | Davis | B26B 29/02 30/2 |
| D323,967 | S | 2/1992 | Talbot | |
| 5,285,577 | A * | 2/1994 | Carney | A45C 11/18 30/289 |
| 5,325,594 | A * | 7/1994 | Szafranski | B26B 5/005 30/293 |
| D352,440 | S | 11/1994 | Perigny | |
| D362,168 | S * | 9/1995 | Mancini | D8/98 |

(Continued)

FOREIGN PATENT DOCUMENTS

WO 2017079035 A1 5/2017

*Primary Examiner* — Sean M Michalski

(74) *Attorney, Agent, or Firm* — Leech Tishman Fuscaldo & Lampl; Peter L. Holmes, Esq.

(57) ABSTRACT

A hand-held cutting tool includes a handle and one or more embedded blade cutters at a distal end portion of the handle, the cutter(s) each having a channel within which a blade with a cutting edge is secured/held, one of the channels including a protrusion shaped to laterally redirect an item to be cut in relation to a side wall of the channel and/or being provided in part by a wing portion of the cutting tool.

16 Claims, 4 Drawing Sheets

(56) References Cited

U.S. PATENT DOCUMENTS 5,561,905 A * 10/1996 Sherman ..... B26B 27/00 30/280
D377,595 S 1/1997 Wiezenthal
6,195,896 B1 3/2001 Ireland
6,371,844 B1 * 4/2002 Holler ..... A22B 5/168 30/278
D498,404 S 11/2004 Schmidt
D540,647 S 4/2007 Ireland
D575,613 S 8/2008 Jennings
D582,746 S 12/2008 Neiser
7,870,675 B1 * 1/2011 Della Polla ..... B26B 29/06 30/2
7,958,639 B2 * 6/2011 Ireland ..... B26B 3/08 30/2
D660,675 S * 5/2012 Gringer ..... D8/98
D673,440 S 1/2013 Kempker et al.
D682,065 S 5/2013 Gringer et al.
D701,741 S 4/2014 Gringer et al.
D714,611 S 10/2014 Yu Chen
D714,612 S 10/2014 Gropl et al.
8,869,408 B2 * 10/2014 Votolato ..... B67B 7/30 30/294
D752,942 S 4/2016 Rohrbach
D767,966 S 10/2016 Standlee
10,668,638 B2 * 6/2020 Mayes ..... B26B 5/00
2005/0274026 A1 * 12/2005 Lee ..... B26B 3/00 30/294
2010/0101028 A1 * 4/2010 Cheldin ..... B25C 11/00 7/160
2011/0232103 A1 * 9/2011 Sendel ..... B26B 3/08 30/152
2015/0298330 A1 * 10/2015 Yu Chen ..... B26B 27/005 30/280
2018/0229380 A1 * 8/2018 Gringer ..... B26B 27/005
2020/0101632 A1 * 4/2020 Seferi ..... B26B 9/02
2020/0131015 A1 * 4/2020 Votolato ..... B26B 27/00
2020/0215708 A1 * 7/2020 Nguyen ..... B26B 27/005

* cited by examiner

WINGED CUTTER

CROSS-REFERENCE TO RELATED APPLICATIONS

This application is a continuation-in-part of U.S. Design patent application Ser. No. 29/618,904, entitled "Winged Cutter" filed on Sep. 25, 2017, which is hereby incorporated by reference.

TECHNICAL FIELD

The present invention relates generally to cutters and cutter apparatuses, in particular, hand-held cutting tools including a handle and one or more embedded blade cutters at a distal end portion of the handle, the cutter(s) each having a channel within which a blade with a cutting edge is secured/held, one of the channels including a protrusion shaped to laterally redirect an item to be cut in relation to a side wall of the channel and/or being provided in part by a wing portion of the cutting tool.

BACKGROUND ART

A great variety of knives, cutters, safety cutters, and cutter apparatuses are known. Features variously found in prior knives, cutters, safety cutters, and cutter apparatuses include mechanisms and devices facilitating, for example, blade deployment, blade change, or blade storage.

Hand held cutting devices having a cutting channel with a blade recessed therein are known. See e.g., U.S. Pat. Nos. D498,404 S, D714,611 S and D767,966 S.

It would be useful to be able to provide a hand-held cutting tool that has a cutting head channel with a cutting edge secured/held therein with surfaces or other structures that laterally redirect an item being advanced along the channel during a cutting operation to prevent the item (e.g., a film or other thin material) from first making contact with the cutting edge at an acute intersection point of the cutting edge and a side of the channel (and, as a result, catching or getting wedged into the acute intersection point).

It would be useful to be able to provide such a hand-held cutting tool in which the cutting tool includes an additional cutting head channel with a cutting edge secured/held therein and configured for cutting a second different type of item (e.g., a relatively thicker material such as cardboard).

It would be useful to be able to provide, for a hand-held cutting tool that has two embedded blade cutters each with a channel within which a blade with a cutting edge is secured/held, cutting head wing (or hook) portions that are different in shape and configured to accommodate different types of materials to be cut by the two embedded blade cutters, respectively.

It would be useful to be able to provide a hand-held cutting tool with a distal end portion that includes one or more cutting heads with improved structural integrity, durability or strength and/or a structure at the distal end portion facilitating improved gripability and handling of the cutting tool.

SUMMARY OF THE INVENTION

In an example embodiment, a hand-held cutting tool includes a handle and a cutting head connected to the handle, the cutting head including a channel having a blade with a cutting edge secured/held therein, the channel including a protrusion curving and laterally extending from a side wall of the channel and shaped to laterally redirect an item to be cut in relation to the side wall as the item is advanced along the channel toward the cutting edge during a cutting operation.

In an example embodiment, a hand-held cutting tool includes a handle configured for gripping about a lengthwise portion of the handle between opposite ends thereof and one or more cutting heads connected to the handle, the cutting head(s) including two channels, the channels each having a cutting edge therein at the same end of the handle at opposite sides thereof respectively, one of the channels including a protrusion therein shaped to laterally redirect an item in relation to a side wall of the channel as the item is advanced/repositioned along the channel moving toward the cutting edge of the one channel during a cutting operation.

In an example embodiment, a hand-held cutting tool includes a handle configured for gripping about a lengthwise portion of the handle between opposite ends thereof and two embedded blade cutters each with a channel within which a blade with a cutting edge is secured/held at a distal end portion of the handle at opposite sides of the distal end portion, respectively, the two embedded blade cutters each having a wing portion, the wing portions being different in shape and including a long wing and a short wing extending from a distal most end of the cutting tool, the long wing being longer as measured lengthwise along the handle than the short wing.

In an example embodiment, a hand-held cutting tool includes a handle configured for gripping about a lengthwise portion of the handle between opposite ends thereof with one or more cutting heads being connected to the handle, the handle including a recess at a side thereof, the handle including, and the recess being in part defined by, a ring-like curved periphery portion at a base of the handle, the handle including an additional recess at the side of the handle, the handle including an arcuate ridge that defines a distal most convex inner periphery portion of the recess and at an opposite side of the arcuate ridge, a concave inner periphery portion of the addition recess.

DISCLOSURE OF INVENTION

Figure 1:
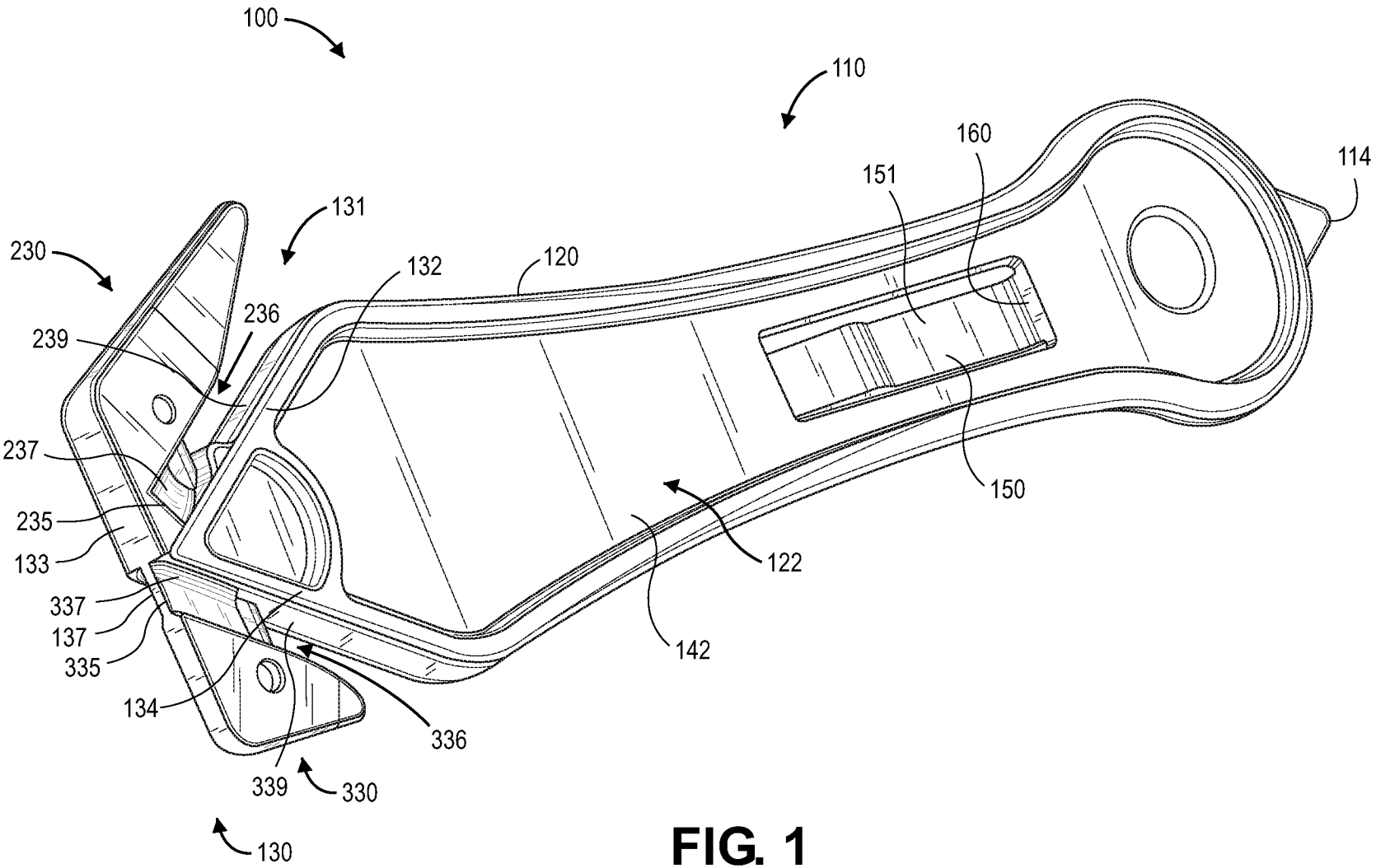
FIG. 1 is a left side isometric perspective view of an example embodiment of a hand-held cutting tool (or cutter apparatus, or winged cutter) showing a distal end portion of the handle and wing portions including a long wing and a short wing extending from a distal most end of the cutting tool.
Figure 2:
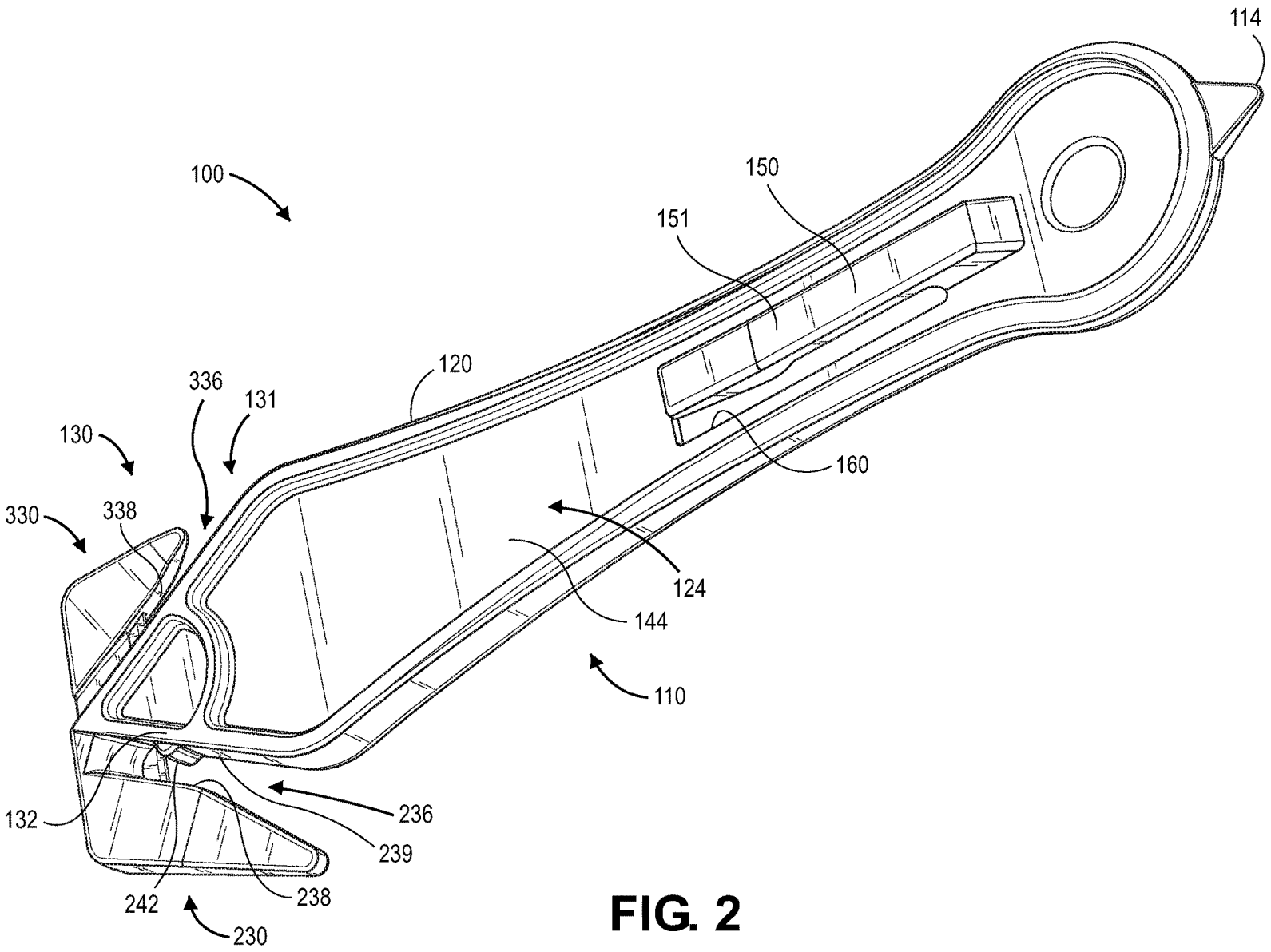
FIG. 2 is a right side isometric perspective view of the winged cutter of FIG. 1 showing a ring-like curved periphery portion at a base of the handle and a tape splitter extending from a proximal end of the ring-like curved periphery portion.

Referring to FIGS. 1-8, in an example embodiment, a hand-held cutting tool (or cutting apparatus) 100 includes a housing 110 (e.g., shaped to be hand-held as shown), an embedded blade (or blades) 112 and a tape splitter (or tape splitter component) 114. The housing 110 includes a handle (or handle portion) 120, and has a left side 122 and a right side 124 at opposite sides of the blade 112. The housing 110 includes a cutting head (portion) 130 at a distal end (or distal end portion) 131 of the handle 120. As shown in FIGS. 1-4, the handle 120 includes recesses 142 and 144 at the left side 122 and the right side 124, respectively, of the handle 120 (e.g., recessed side portions/areas of the handle as shown). In this illustrated example embodiment, the housing 110 also includes a clip 150 that is connected to (or integrally formed with) the handle 120, the clip 150 including a resilient member 151 extending generally lengthwise along the handle (e.g., shaped/configured as shown). An opening 160 is provided through the handle 120 facing the clip 150 as shown. In an alternative embodiment, the handle (or handle portion) 120 does not include the clip 150 (or any other clip) or the opening 160.

The housing 110 and the tape splitter 114 can be formed of various materials, for example, a moldable composite material (e.g., a material: glass-filled polymer or glass-filled plastic (GF), polytetrafluoroethylene (PTFE) nylon), and by various processes (e.g., insert molded). For example, the housing 110 can be molded or otherwise formed around the blade 112 such that the left and right sides of the housing are (permanently) positioned in relation to each other with the blade 112 secured therebetween and adjacent to each other. The term "embedded blade" can refer (for example) to a blade that is secured within or to or otherwise connected to a cutting head and/or handle of a hand-held cutting tool. The blade 112 can be formed of various materials, for example, steel (e.g., SAE 1095 steel heat treated to HRC 58-60).

Figure 3:
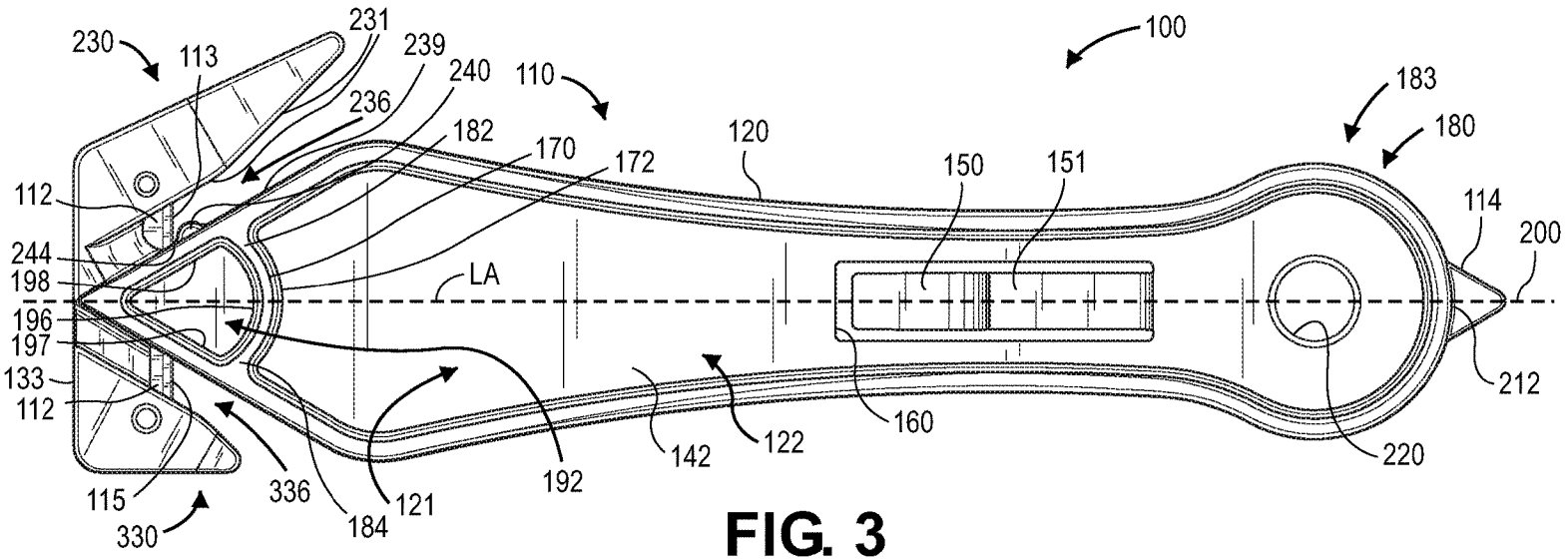
FIG. 3 is a left side view of the winged cutter of FIG. 1.
Figure 4:
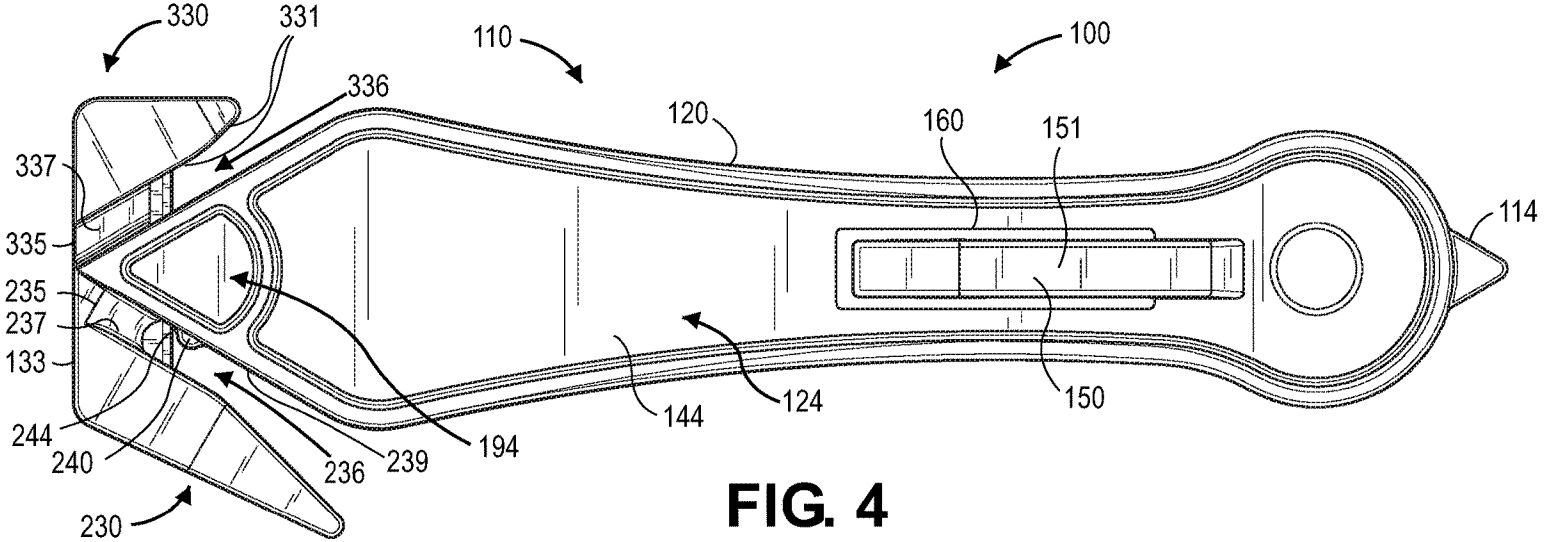
FIG. 4 is a right side view thereof.
Figure 6:
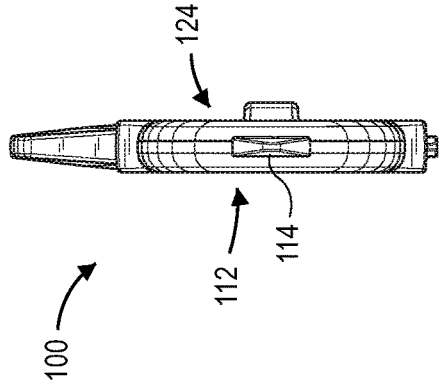
FIG. 6 is a rear view thereof.
Figure 5:
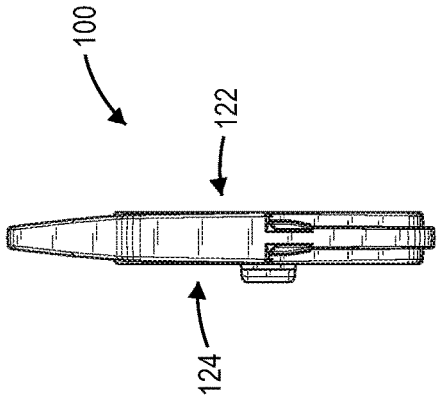
FIG. 5 is a front view thereof.

Referring again to FIGS. 1-4, the cutting head (portion) 130 includes one or more cutting heads connected to the handle 120. For example, the handle 120 is configured for gripping about a lengthwise portion 121 of the handle 120 between opposite ends thereof. In this example embodiment, the cutting head(s) include two channels—(cutting) channels 236 and 336, the channels each having a cutting edge therein at the same end of the handle at opposite sides thereof respectively. In this example embodiment, the one or more cutting heads have wing portions including a long wing 230 and a short wing 330 that define outer side walls 238 and 338 of the channels 236 and 336, respectively; the long wing 230 is longer as measured lengthwise along the handle 120 than the short wing 330; and the channel 236 includes a protrusion 240 therein facing the long wing 230. The protrusion 240 is shaped, e.g., curving and laterally extending from a side wall 239 of the channel 236 as shown in FIGS. 3 and 4, to laterally redirect an item in relation to the side wall 239 as the item is advanced/repositioned along the channel 236 toward a cutting edge (or cutting edge portion) 113 of the blade 112 during a cutting operation.

In example embodiments and implementations, a hand-held cutting tool is provided that has a cutting head channel with a cutting edge secured/held therein with surfaces or other structures that laterally redirect an item being advanced along the channel during a cutting operation to prevent the item (e.g., a film or other thin material) from first making contact with the cutting edge at an acute intersection point of the cutting edge and a side of the channel (and, as a result, catching or getting wedged into the acute intersection point). Referring to FIGS. 3 and 4, in this example embodiment, the protrusion 240 is a bump that extends from the side wall 239 smoothly curving/transitioning from the side wall along the channel 236 to a raised profile 242 (e.g., as shown) and smoothly curving/transitioning back into the side wall 239 (immediately/)directly adjacent to a location 244 at the side wall 239 of the channel 236 where the cutting edge 113 extends from and intersects with the side wall 239 of the channel. The side wall 239 of the channel 236 and the cutting edge 113 form an angle of approximately 60° (e.g., between 50° and 70°). The protrusion 240 extends, in height (normally) from the side wall 239 of the channel 236, less than half way across the (width of the) channel 236 (from the side wall 239 to the outer side wall 238). The side wall 239 of the channel 236 from which the protrusion 240 extends is an external side edge/portion 132 of the handle 120 at the distal end portion 131 of the handle 120.

Thus, in an example embodiment, a hand-held cutting tool includes a handle and a cutting head connected to the handle, the cutting head including a channel having a blade with a cutting edge secured/held therein, the channel including a protrusion curving and laterally extending from a side wall of the channel and shaped to laterally redirect an item to be cut in relation to the side wall as the item is advanced along the channel toward the cutting edge during a cutting operation. In an example embodiment, the protrusion is a bump that extends from the side wall smoothly curving/transitioning from the side wall along the channel to a raised profile and smoothly curving/transitioning back into the side wall directly adjacent to a location at the side wall of the channel where the cutting edge extends from and intersects with the side wall of the channel. By way of example, the side wall of the channel and the cutting edge form an angle of approximately 60° and/or the protrusion extends from the side wall of the channel less than half way across the width of the channel. In example embodiments and implementations, the side wall of the channel from which the protrusion extends is an external side edge/portion of the handle at a distal end portion of the handle.

In example embodiments and implementations, a hand-held cutting tool is provided in which the cutting tool includes an additional cutting head channel with a cutting edge secured/held therein and configured for cutting a second different type of item (e.g., a relatively thicker material such as cardboard). In the illustrated example embodiment, such an additional cutting head channel is provided/defined in part by the short wing 330, which is configured without a protrusion (such as discussed in relation to the channel 236 provided/defined in part by the long wing 230) and shaped for cutting a relatively thicker material such as cardboard (rather than a film or other thin material). Referring to FIGS. 3 and 4, the channel 336 is defined at opposite sides thereof by the outer side wall 338 (of the short wing 330) and a side wall 339, which is provided by (i.e., is part of) an external side edge/portion 134 of the handle 120 at the distal end portion 131 of the handle 120. A cutting edge (or cutting edge portion) 115 is secured/held within the channel 336 (e.g., as shown). Accordingly, in this example embodiment, the channels 236 and 336 each have a cutting edge therein at the same end of the handle at opposite sides thereof respectively. The long wing 230 and the short wing 330 both extend from a distal most end (or planar surface) 133 of the cutting tool. The long wing 230 and the short wing 330 are different in shape (e.g., respectively provided as shown). The long wing 230 and the short wing 330 include surfaces (or surface areas) 231 and 331, respectively, defining (portions of) the outer side walls of the channels 236 and 336 such that the channels of the cutting head(s) are wider at end(/proximal) portions 243 and 343 of the long wing 230 and the short wing 330 than at the cutting edges 113 and 115 of the channels, respectively. In this example embodiment, the cutting edges 113 and 115 are provided by a single (the same) embedded blade (e.g., a single unitary piece/component secured/held within the cutting head portion 130 of the cutting tool (or winged cutter). Alternatively, the cutting edges 113 and 115 can be provided by different (e.g., separate) blades. In other embodiments, the cutting edges 113 and 115 are shaped differently (e.g., curved at a cutting edge portion within a channel) and/or have a different cutting edge orientation (e.g., angle) in relation to the side walls of a channel. Thus, in an example embodiment, a hand-held cutting tool includes a handle configured for gripping about a lengthwise portion of the handle between opposite ends thereof and one or more cutting heads connected to the handle, the cutting head(s) including two channels, the channels each having a cutting edge therein at the same end of the handle at opposite sides thereof respectively, one of the channels including a protrusion therein shaped to laterally redirect an item in relation to a side wall of the channel as the item is advanced/repositioned along the channel moving toward the cutting edge of the one channel during a cutting operation. In example embodiments, the one or more cutting heads have wing portions including a long wing and a short wing that define outer side walls of the channels, the long wing being longer as measured lengthwise along the handle than the short wing, and the protrusion faces the long wing.

Figure 7:
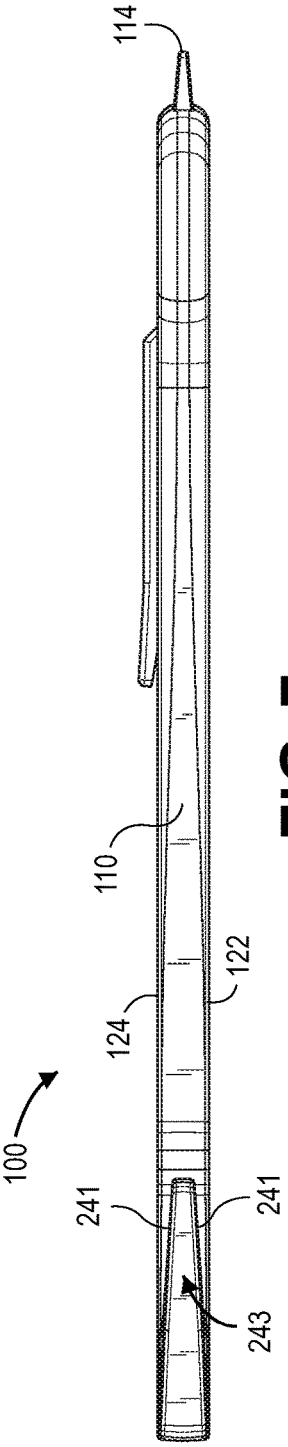
FIG. 7 is a top view thereof.
Figure 8:
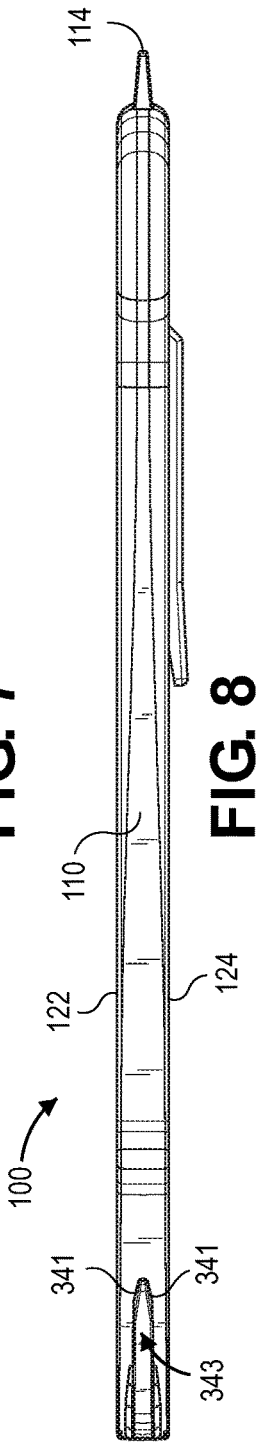
FIG. 8 is a bottom view thereof.

In example embodiments and implementations, a hand-held cutting tool has two embedded blade cutters each with a channel within which a blade with a cutting edge is secured/held, the embedded blade cutters each have a cutting head wing (or hook) portion, and the wing (or hook) portions are different in shape and configured to accommodate different types of materials to be cut by the two embedded blade cutters, respectively. By way of example, such wing (or hook) portions including a long wing and a short wing extending from a distal most end of the cutting tool, the long wing being longer as measured lengthwise along the handle than the short wing. In the illustrated example embodiment, the channel 236 of the embedded blade cutter including the long wing 230 is defined at opposite sides thereof by the external side edge/portion 132 of the handle 120 at a distal end 131 of the handle 120 and surfaces (or surface areas) 231 of the long wing 230. And the channel 336 of the embedded blade cutter including the short wing 330 is defined at opposite sides thereof by the external side edge/portion 134 of the handle 120 at a distal end 131 of the handle 120 and surfaces (or surface areas) 331 of the long wing 230. The surfaces (or surface areas) 231 of the long wing 230 face the handle 120 and are provided/formed (e.g., at different angles, respectively) such that the channel 236 is wider at the end(/proximal) portion 243 of the long wing 230. The surfaces (or surface areas) 331 of the short wing 330 face the handle 120 and are provided/formed (e.g., at different angles, respectively) such that the channel 336 is wider at the end(/proximal) portion 343 of the short wing 330. Referring to FIGS. 7 and 8, the end(/proximal) portion 243 of the long wing 230 includes tapered surfaces 241 at opposite (left and right) sides thereof as shown. The end(/proximal) portion 343 of the short wing 330 includes tapered surfaces 341 at opposite (left and right) sides thereof as shown, and is narrower and sharper at its tip than the end(/proximal) portion 243 of the long wing 230.

Referring to FIGS. 1-4, in this example embodiment, the channel 236 of the embedded blade cutter including the long wing 230 includes generally U-shaped channel portions 237 (e.g., curved surface as shown) distal to the cutting edge 113 at opposite sides of the blade that guide the item as the item is advanced further along the channel 236 toward distal exits/ends 235 of the channel 236 after the item is cut, the distal exits/ends 235 of the channel emerging at opposite (left and right) sides of the long wing 230 proximal in relation to the distal most end (or planar surface) 133. The channel 336 of the embedded blade cutter including the short wing 330 includes generally U-shaped channel portions 337 (e.g., curved surface as shown) distal to the cutting edge 115 at opposite sides of the blade that guide the item as the item is advanced further along the channel 336 toward distal exits/ends 335 of the channel 236 after the item is cut, the distal exits/ends 335 of the channel emerging at the distal most end (or planar surface) 133 and defining a narrowest portion 137 of the distal most end (or planar surface) 133.

Thus, in an example embodiment, a hand-held cutting tool includes a handle configured for gripping about a lengthwise portion of the handle between opposite ends thereof and two embedded blade cutters each with a channel within which a blade with a cutting edge is secured/held at a distal end portion of the handle at opposite sides of the distal end portion, respectively, the two embedded blade cutters each having a wing portion, the wing portions being different in shape and including a long wing and a short wing extending from a distal most end of the cutting tool, the long wing being longer as measured lengthwise along the handle than the short wing. In example embodiments, the channel of the embedded blade cutter including the long wing is defined at opposite sides thereof by a side edge/portion of the handle and surfaces of the long wing. The channel of the embedded blade cutter including the long wing includes a protrusion extending from the side edge/portion of the handle and facing the long wing. The channel of the embedded blade cutter including the short wing does not include any protrusions along the channel that face the cutting edge. In example embodiments, the surfaces of the long wing face the handle and are provided/formed such that the channel is wider at an end(/proximal) portion of the long wing. In example embodiments, the channel of the embedded blade cutter including the long wing includes generally U-shaped channel portions distal to the cutting edge at opposite sides of the blade that guide the item as the item is advanced further along the channel toward distal exits/ends of the channel after the item is cut, the distal exits/ends of the channel emerging at opposite sides of the long wing proximal in relation to the distal most end of the cutting tool. In example embodiments, the channel of the embedded blade cutter including the short wing includes generally U-shaped channel portions distal to the cutting edge at opposite sides of the blade that guide the item as the item is advanced further along the channel toward distal exits/ends of the channel after the item is cut, the distal exits/ends of the channel emerging at the distal most end of the cutting tool and defining a narrowest portion of the distal most end.

In example embodiments and implementations, a hand-held cutting tool is provided with a distal end portion that includes one or more cutting heads having improved structural integrity, durability or strength and/or a structure at the distal end portion facilitating improved gripability and handling of the cutting tool. By way of example, the handle includes a recess (or recessed portion or area), such as the recesses 142 and 144 at the left and right sides of the handle, and an arcuate ridge 170 that defines a distal most (convex) inner periphery portion 172 of the recess; and the arcuate ridge 170 at opposite ends 182, 184 thereof is generally normal/perpendicular to and adjoins (e.g., is integrally formed with) the side edge/portion 132 and the side edge/portion 134 (adjacent to the cutting channels 236 and 336), respectively, at the opposite sides of the distal end 131 of the handle. In this example embodiment, the handle 120 includes, and the recess is in part defined by, a ring-like curved periphery portion 180 at a base (proximal portion) 183 of the handle 120; and the handle 120 includes an additional recess (or recessed portion or area), such as the additional recesses 192 and 194 at the left and right sides of the handle, and the arcuate ridge 170 defining at an opposite/distal side thereof, a (concave) inner periphery portion 196 of the addition recess. Referring to FIG. 3, in this example embodiment, the additional recess has an irregular shape defined by three (contiguous) inner periphery surfaces (or sections) provided by two (symmetrical) (substantially linear) periphery side wall portions 197, 198 of the handle and by the (concave) inner periphery portion 196. The inner periphery surfaces (or sections) provided by the two periphery side wall portions 197, 198 are of equal length and equal angles in relation to a symmetry axis, namely, a central longitudinal axis 200 (denoted "LA") of the handle. The handle 120 further includes the tape splitter 114 (e.g., integrally formed with and) extending from a proximal end 212 of the ring-like curved periphery portion 180. In this example embodiment, the tape splitter 210 is centered and symmetrical in shape in relation to the central longitudinal axis 200 of the handle. In example embodiments, the hand-held cutting tool 100 includes, within the ring-like curved periphery portion 180 at the base (proximal portion) 182 of the handle 120, an opening 220 (e.g., a lanyard or hanger hole opening provided as shown).

Thus, in an example embodiment, a hand-held cutting tool includes a handle configured for gripping about a lengthwise portion of the handle between opposite ends thereof with one or more cutting heads being connected to the handle, the handle including a recess at a side thereof, the handle including, and the recess being in part defined by, a ring-like curved periphery portion at a base of the handle, the handle including an additional recess at the side of the handle, the handle including an arcuate ridge that defines a distal most convex inner periphery portion of the recess and at an opposite side of the arcuate ridge, a concave inner periphery portion of the addition recess. By way of example, the additional recess has an irregular shape defined by three contiguous inner periphery surfaces provided by two periphery side wall portions of the handle and by the concave inner periphery portion. In example embodiments, the inner periphery surfaces provided by the two periphery side wall portions are of equal length. The one or more cutting heads include two embedded blade cutters at opposite sides of the handle, the embedded blade cutters each having a channel within which a blade is held/secured; and the arcuate ridge at opposite ends thereof is generally normal/perpendicular to and adjoins the two side wall portions at the opposite sides of the handle, respectively. In example embodiments, the arcuate ridge at the opposite ends thereof is integrally formed with the side wall portions. The handle further includes a tape splitter extending from a proximal end of the ring-like curved periphery portion. In example embodiments, the tape splitter is integrally formed with the proximal end of the ring-like curved periphery portion. The tape splitter is centered and symmetrical in shape in relation to a central longitudinal axis of the handle.

Although the present invention(s) has(have) been described in terms of the example embodiments above, numerous modifications and/or additions to the above-described embodiments would be readily apparent to one skilled in the art. It is intended that the scope of the present invention(s) extend to all such modifications and/or additions.

What is claimed is:

1. A hand-held cutting tool comprising:

a handle; and a cutting head connected to the handle, the cutting head including a channel having a blade with a cutting edge secured/held therein, the channel including a protrusion curving and laterally extending from a side wall of the channel and shaped to laterally redirect an item to be cut in relation to the side wall as the item is advanced along the channel toward the cutting edge during a cutting operation.

2. The hand-held cutting tool of claim 1, wherein the protrusion is a bump that extends from the side wall smoothly curving/transitioning from the side wall along the channel to a raised profile and smoothly curving/transitioning back into the side wall directly adjacent to a location at the side wall of the channel where the cutting edge extends from and intersects with the side wall of the channel.

3. The hand-held cutting tool of claim 1, wherein the side wall of the channel and the cutting edge form an angle of approximately 60°.

4. The hand-held cutting tool of claim 1, wherein the protrusion extends from the side wall of the channel less than half way across the width of the channel.

5. The hand-held cutting tool of claim 1, wherein the side wall of the channel from which the protrusion extends is an external side edge/portion of the handle at a distal end portion of the handle.

6. A hand-held cutting tool comprising:

a handle configured for gripping about a lengthwise portion of the handle between opposite ends thereof; and one or more cutting heads connected to the handle, the cutting head(s) including two channels, the channels each having a cutting edge therein at the same end of the handle at opposite sides thereof respectively, one of the channels including a protrusion therein shaped to laterally redirect an item in relation to a side wall of the channel as the item is advanced/repositioned along the channel moving toward the cutting edge of the one channel during a cutting operation.

7. The hand-held cutting tool of claim 6, wherein the one or more cutting heads have wing portions including a long wing and a short wing that define outer side walls of the channels, the long wing being longer as measured lengthwise along the handle than the short wing, the protrusion facing the long wing.

8. The hand-held cutting tool of claim 7, wherein the long wing and the short wing both extend from a distal most end of the cutting tool.

9. The hand-held cutting tool of claim 7, wherein the long wing and the short wing are different in shape.

10. The hand-held cutting tool of claim 7, wherein the long wing and the short wing include surfaces defining the outer side walls of the channels such that the channels of the cutting head(s) are wider at end portions of the long wing and the short wing than at the cutting edges of the channels, respectively.

11. The hand-held cutting tool of claim 6, wherein the cutting edges are provided by a single embedded blade.

12. A hand-held cutting tool comprising a handle configured for gripping about a lengthwise portion of the handle between opposite ends thereof, and two embedded blade cutters each with a channel within which a blade with a cutting edge is secured/held at a distal end portion of the handle at opposite sides of the distal end portion, respectively, the two embedded blade cutters each having a wing portion, the wing portions being different in shape and including a long wing and a short wing extending from a distal most end of the cutting tool, the long wing being longer as measured lengthwise along the handle than the short wing, and wherein the channel of the embedded blade cutter including the long wing is defined at opposite sides thereof by a side edge/portion of the handle and surfaces of the long wing; and, wherein the channel of the embedded blade cutter including the long wing includes a protrusion extending from the side edge/portion of the handle and facing the long wing.

13. The hand-held cutting tool of claim 12, wherein the channel of the embedded blade cutter including the short wing does not include any protrusions along the channel that face the cutting edge.

14. The hand-held cutting tool of claim 12, wherein the surfaces of the long wing face the handle and are provided/formed such that the channel is wider at an end portion of the long wing.

15. The hand-held cutting tool of claim 12, wherein the channel of the embedded blade cutter including the long wing includes generally U-shaped channel portions distal to the cutting edge at opposite sides of the blade that guide the item as the item is advanced further along the channel toward distal exits/ends of the channel after the item is cut, the distal exits/ends of the channel emerging at opposite sides of the long wing proximal in relation to the distal most end of the cutting tool.

16. The hand-held cutting tool of claim 12, wherein the channel of the embedded blade cutter including the short wing includes generally U-shaped channel portions distal to the cutting edge at opposite sides of the blade that guide the item as the item is advanced further along the channel toward distal exits/ends of the channel after the item is cut, the distal exits/ends of the channel emerging at the distal most end of the cutting tool and defining a narrowest portion of the distal most end.

* * * * *